US009308772B2

(12) United States Patent
Anderson

(10) Patent No.: US 9,308,772 B2
(45) Date of Patent: Apr. 12, 2016

(54) PENCIL ERASER ADAPTER

(71) Applicant: Philip Anderson, Rushville, NY (US)

(72) Inventor: Philip Anderson, Rushville, NY (US)

( * ) Notice: Subject to any disclaimer, the term of this patent is extended or adjusted under 35 U.S.C. 154(b) by 193 days.

(21) Appl. No.: 13/928,012

(22) Filed: Jun. 26, 2013

(65) Prior Publication Data

US 2014/0068907 A1 Mar. 13, 2014

Related U.S. Application Data

(60) Provisional application No. 61/699,637, filed on Sep. 11, 2012.

(51) Int. Cl.
*B43K 29/02* (2006.01)
*B43L 19/00* (2006.01)

(52) U.S. Cl.
CPC ..... *B43L 19/0075* (2013.01); *B43K 29/02* (2013.01); *Y10T 29/49732* (2015.01)

(58) Field of Classification Search
CPC ..... B43K 29/02; B43K 29/18
USPC ..... 15/424–426, 257.01; 401/52, 88
See application file for complete search history.

(56) References Cited

U.S. PATENT DOCUMENTS

| | | | | | |
|---|---|---|---|---|---|
| 1,267,955 | A | * | 5/1918 | Balch | B43K 29/02 15/430 |
| 1,483,957 | A | * | 2/1924 | Trygge | 15/424 |
| 1,998,684 | A | * | 4/1935 | Musgrave | 15/424 |
| 3,262,425 | A | * | 7/1966 | Waugh | B43K 29/02 15/431 |

* cited by examiner

*Primary Examiner* — Jennifer C Chiang
*Assistant Examiner* — Bradley Oliver
(74) *Attorney, Agent, or Firm* — Richard C. Litman

(57) ABSTRACT

A pencil adapter for attaching a new eraser to a pencil. The pencil adapter may include a hollow body forming a first cavity on a first end and a second cavity on a second end, with a divider in between. The first end may be attached to the eraser end of a pencil and a new eraser may fit in the second end.

2 Claims, 3 Drawing Sheets

PENCIL ERASER ADAPTER

BACKGROUND OF THE INVENTION

The present invention relates to a pencil eraser adapter and, more particularly, to a pencil eraser adapter used to extend the life of a pencil.

A pencil is a writing implement or art medium usually constructed of a narrow, solid pigment core inside a protective casing. The case prevents the core from breaking, and also from marking the user's hand during use. Typically, the pencil may include an end exposing the core and an opposite end with an eraser. The original eraser on a pencil is usually used up or may harden prior to the full use of the pencil. Therefore, pencils with non-functioning erasers may be thrown out prematurely or a user must carry around a separate eraser. Certain replacement erasers that are used to remedy this tend not to work because the gum of the eraser cannot hold together under the pressure exerted during the erasing and thereby break apart.

As can be seen, there is a need for a device that attaches a new eraser to a user pencil.

SUMMARY OF THE INVENTION

In one aspect of the present invention, a pencil adapter comprises: a body having a first end and a second end, wherein the body is substantially hollow forming a first cavity at the first end and a second cavity at the second end; a divider within the substantially hollow body, wherein the divider separates the first cavity from the second cavity, wherein the first cavity comprises a first inner wall and a first outer wall, and the second cavity comprises a second inner wall and a second outer wall, wherein the first cavity is formed to fit on an eraser end of a pencil and the second cavity is formed to receive an eraser.

In another aspect of the present invention, a method of providing a new eraser to a pencil comprises: providing a pencil adapter comprising: a body having a first end and a second end, wherein the body is substantially hollow forming a first cavity at the first end and a second cavity at the second end; a divider within the substantially hollow body, wherein the divider separates the first cavity from the second cavity; securing an eraser within the second cavity; and securing an eraser end of a pencil within the first cavity.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a pencil adapter for attaching a new eraser to a pencil. The pencil adapter may include a hollow body forming a first cavity on a first end and a second cavity on a second end, with a divider in between. The first end may be attached to the eraser end of a pencil and a new eraser may fit in the second end.

The present invention may include an adapter that may fit onto the end of a pencil and may secure a pencil eraser. The eraser holder of the present invention may allow for a new eraser to be attached to the top of the partially used pencil. The pencil may therefore regain its full functionality for the duration of its lifespan. The present invention permits for a high quality eraser to be attached to the top of the pencil and may be of an equal or greater quality than the original eraser.

Figure 1:
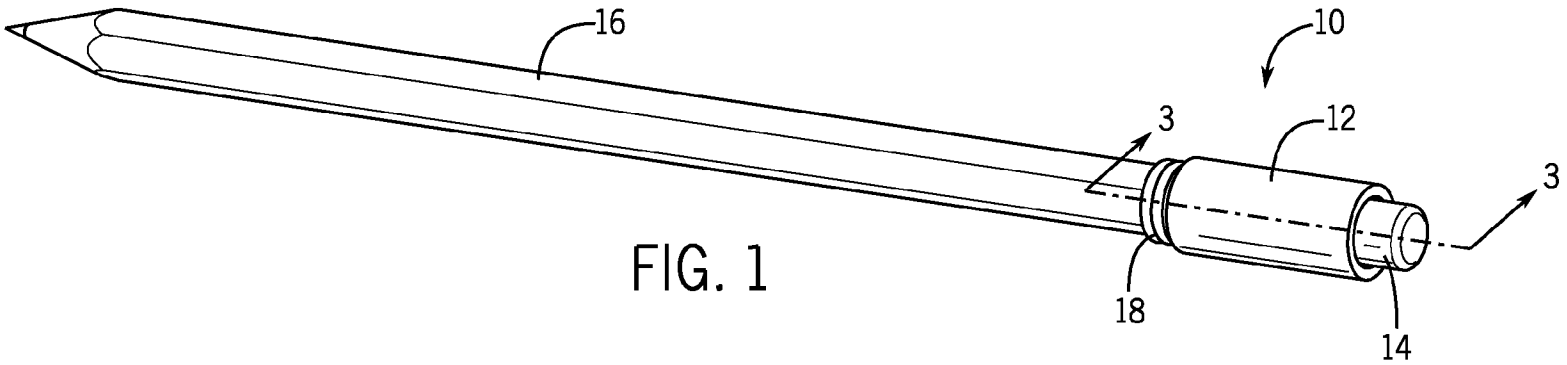
FIG. 1 is a perspective view of the present invention being used with an exemplary pencil.
Figure 2:
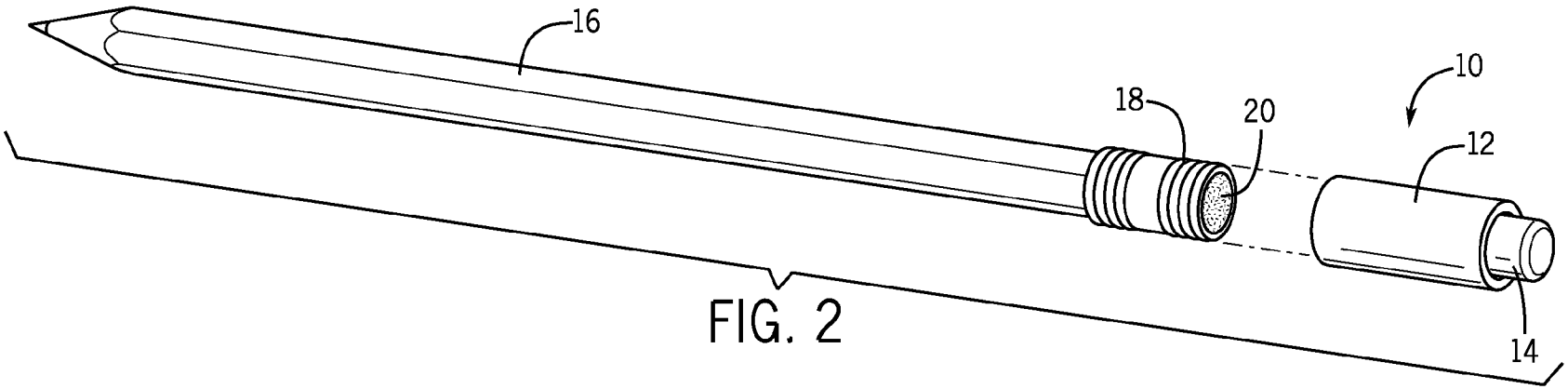
FIG. 2 is an exploded perspective view of FIG. 1.
Figure 3:
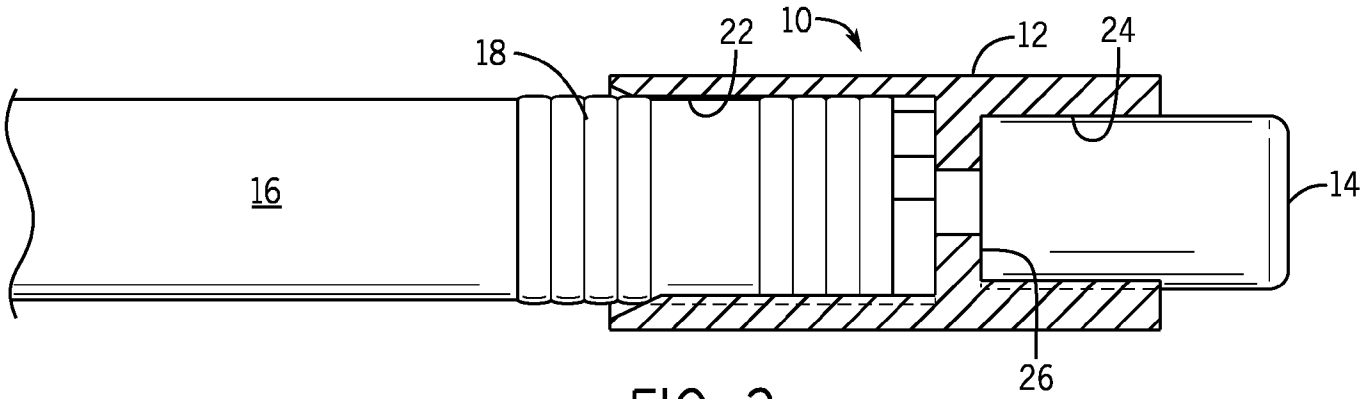
FIG. 3 is a cross-sectional view taken on line 3-3 of FIG. 1.
Figure 4:
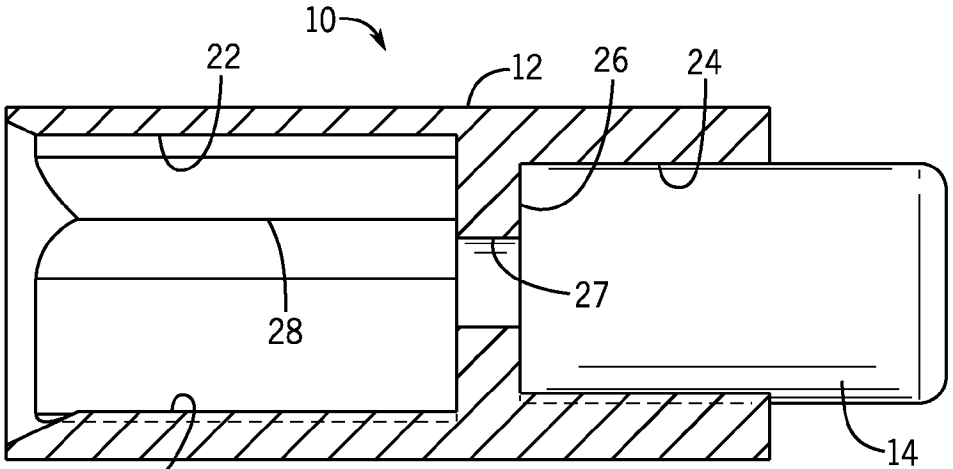
FIG. 4 is a cross-sectional view similar to FIG. 3, illustrated only with the adapter of FIG. 1.
Figure 5:
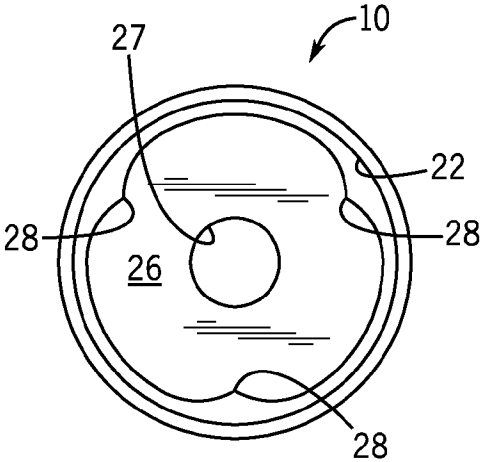
FIG. 5 is an end view of the adapter of FIG. 1.
Figure 6:
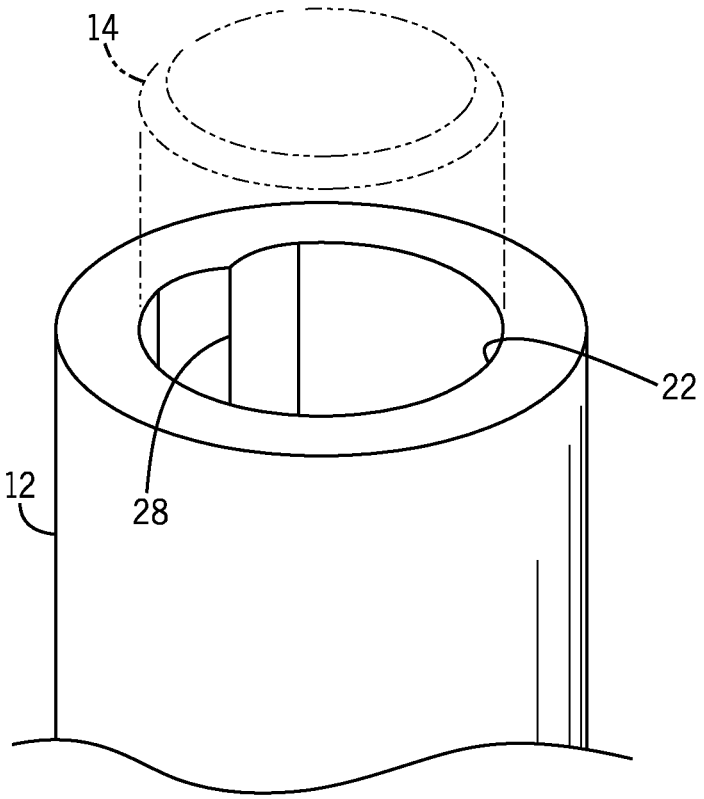
FIG. 6 is a detail perspective view of the present invention.

Referring to FIGS. 1 through 6, the present invention may include a pencil adapter 10. The pencil adapter 10 may include a body 12 having a first end and a second end. The body 12 of the pencil adapter 10 may be substantially hollow, forming a first cavity 22 at the first end having an inner wall and an outer wall and a second cavity 24 at the second end having an inner wall and an outer wall. A divider 26 may be within the hollow center of the body 12 and may separate the first cavity 22 from the second cavity 24. In certain embodiments, the divider 26 may form an opening 27 at its center. The body 12 of the present invention may be made of a plastic and/or metal.

In certain embodiments, the first end of the pencil adapter 10 may be attached to a pencil 16 and an adapter eraser 14 may be attached to the second end. For example, the erasure ferrule 18 of the pencil 16 may fit snuggly within the first cavity 22 and the adapter eraser 14 may fit snuggly within the second cavity 24. In certain embodiments, the first cavity 22 and the second cavity 24 may have at least one gripping protrusion 28 extending from the inner walls. For example, there may be three gripping protrusions 28 within the cavities 22, 24. The gripping protrusion 28 may further secure the erasure ferrule 18 within the first cavity 22 and may further secure the eraser within the second cavity 24.

In use, an eraser 14 may be placed snuggly within the second cavity 24 of the body 12. The erasure ferrule 18 may be placed snuggly within the first cavity 22 of the body 12. The pencil adapter 10 of the present invention may attach securely to the pencil 16, which allows the pencil adapter 10 to absorb the pressure of erasing. Therefore, the replacement eraser 14 may be used similar to the original eraser.

It should be understood, of course, that the foregoing relates to exemplary embodiments of the invention and that modifications may be made without departing from the spirit and scope of the invention as set forth in the following claims.

What is claimed is:

1. An eraser adapter for securement to a writing implement, the adapter consisting of:

a one piece elongated body having a first end and a second end, wherein the body is substantially hollow forming a first cavity at the first end and configured to fit on an eraser end of a writing implement and a second cavity at the second end and configured to receive an eraser, each of the cavities being aligned with the longitudinal axis of the elongated body;

a divider formed within the substantially hollow body, wherein the divider separates the first cavity from the second cavity;

wherein the first cavity comprises a first inner wall and a first outer wall, and the second cavity comprises a second inner wall and a second outer wall, wherein each of the inner walls of the cavities includes a plurality of elongated, longitudinally extending gripping protrusions.

2. The eraser adapter of claim 1, wherein the divider includes an opening at the center of the divider.

* * * * *